US010738425B2

(12) United States Patent
Heselden

(10) Patent No.: US 10,738,425 B2
(45) Date of Patent: Aug. 11, 2020

(54) SECURITY BARRIER

(71) Applicant: HESCO BASTION LIMITED, Leeds, Yorkshire (GB)

(72) Inventor: James Heselden, Leeds (GB)

(73) Assignee: HESCO BASTION LIMITED, Leeds (GB)

( * ) Notice: Subject to any disclaimer, the term of this patent is extended or adjusted under 35 U.S.C. 154(b) by 616 days.

(21) Appl. No.: 15/457,715

(22) Filed: Mar. 13, 2017

(65) Prior Publication Data

US 2017/0183833 A1 Jun. 29, 2017

Related U.S. Application Data

(63) Continuation of application No. 12/360,280, filed as application No. PCT/GB2007/050450 on Jul. 26, 2007, now abandoned.

(30) Foreign Application Priority Data

Aug. 15, 2006 (GB) ..... 0616118.6
Dec. 14, 2006 (GB) ..... 0624939.5

(51) Int. Cl.
*E01F 13/02* (2006.01)
*E02D 29/02* (2006.01)
(Continued)

(52) U.S. Cl.
CPC ..... *E01F 13/022* (2013.01); *E02D 29/0208* (2013.01); *E02D 29/0266* (2013.01);
(Continued)

(58) Field of Classification Search
CPC ... E04H 17/161; E04H 17/18; E02D 29/0208; E01F 13/022
See application file for complete search history.

(56) References Cited

U.S. PATENT DOCUMENTS 322,378 A 7/1885 Johnson
1,648,025 A 11/1927 Molloy
(Continued)

FOREIGN PATENT DOCUMENTS

EP 064 1895 3/1995
EP 0647739 4/1995
(Continued)

OTHER PUBLICATIONS

File history of U.S. Appl. No. 12/360,280, filed Feb. 13, 2009.

*Primary Examiner* — Michael P Ferguson
(74) *Attorney, Agent, or Firm* — Ping Wang; Morris, Manning & Martin LLP

(57) ABSTRACT

A security barrier for deployment in crowd control and/or containment, the security barrier being capable of adopting at least two configurations. In a first configuration the security barrier is erected for deployment and comprises a compartment bounded at its front by a front panel for providing a barricade, at its rear by a rear panel of lower height than the front panel, at its sides by respective side panels pivotally connecting the rear and front panels, and at its bottom by a bottom panel connected at least two of the front panel, the rear panel, and the respective side panels. In its second configuration the security barrier is collapsed for storage and/or transportation.

17 Claims, 10 Drawing Sheets

(51) Int. Cl.

| | |
|---|---|
| ***E04H 17/16*** | (2006.01) |
| ***E04H 17/18*** | (2006.01) |
| ***E06B 9/02*** | (2006.01) |
| *E06B 9/00* | (2006.01) |

(52) U.S. Cl.
CPC ..... *E02D 29/0283* (2013.01); *E04H 17/161* (2013.01); *E04H 17/18* (2013.01); *E06B 9/02* (2013.01); *E06B 2009/002* (2013.01)

(56) References Cited

U.S. PATENT DOCUMENTS

| | | | | |
|---|---|---|---|---|
| 2,467,411 | A | 4/1949 | Tingdale | |
| 2,780,381 | A | 2/1957 | Coit, Jr. | |
| 3,269,556 | A | 8/1966 | Streater | |
| 3,311,254 | A | 3/1967 | Beh | |
| 3,479,105 | A | 11/1969 | Farren | |
| 3,945,660 | A | 3/1976 | Zalewski | |
| 4,050,606 | A | 9/1977 | Jurasek | |
| 5,333,970 | A * | 8/1994 | Heselden | E02D 29/0208 405/286 |
| 5,647,695 | A | 7/1997 | Hilfiker et al. | |
| 5,740,724 | A | 4/1998 | Fabrikant et al. | |
| 6,305,883 | B1 | 10/2001 | Ozaki | |
| 6,364,137 | B1 | 4/2002 | Glauth et al. | |
| 6,782,624 | B2 * | 8/2004 | Marsh | E01F 13/12 256/11 |
| 7,325,697 | B2 | 2/2008 | Lim et al. | |
| 2005/0284080 | A1 | 12/2005 | Gallego et al. | |

FOREIGN PATENT DOCUMENTS

| | | |
|---|---|---|
| EP | 0735198 | 10/1996 |
| EP | 1239085 | 9/2002 |
| FR | 2521187 | 8/1983 |
| GB | 2419368 | 4/2006 |
| WO | 9012160 | 10/1990 |
| WO | 2005080691 | 9/2005 |

* cited by examiner

SECURITY BARRIER

This application is a continuation application of U.S. patent application Ser. No. 12/360,280, filed Feb. 13, 2009, and claims priority to PCT/GB2007/050450, filed on Jul. 26, 2007, which claims priority to Great Britain patent Application Nos. 0616118.6, filed Aug. 15, 2006 and 0624939.5, filed Dec. 14, 2006. The entirety of the aforementioned applications is incorporated herein by reference.

FIELD

The present invention relates to a security barrier, and to a crowd control security barrier, particularly to a rapidly deployable and easily transportable crowd control security barrier which can be preferably be recovered after use, and re-used.

BACKGROUND

One common type of security barrier currently in widespread use comprises a wire mesh fence panel extending between two posts, each of which is anchored in a supporting block, generally of concrete or recycled rubber. Such security barriers have been deemed appropriate for many uses, but they are not sufficiently stable or robust to withstand a determined assault, either by an individual or by a crowd attempting to breach the barrier. Other common types of security barrier are based upon similar principles, although the nature of the panel and its means of support may vary somewhat.

WO-A-90/12160 discloses wire mesh cage structures useful as gabions, security barriers with a different function from the crowd control security barriers of the present invention. These gabions are primarily for securing areas against assault by small arms fire, rockets missiles and vehicle-borne explosives, and also by elemental forces such as floods, landslides, avalanches and the like. The gabion cage structure is made up of pivotally interconnected open mesh work frames which are connected together under factory conditions so that the cage can fold concertina-wise to take a flattened form for transportation to site, where it can be erected to take an open multi-compartmental form for filling with a suitable fill material, such as sand, soil, earth or rocks.

WO-A-00/40810 also concerns a multi-compartmental gabion-type security barrier which folds concertina-wise for transportation, and which comprises side walls extending along the length of the multi-compartmental security barrier, the side walls being connected at spaced intervals along the length of the security barrier by partition walls which are formed from two releasably connected sections, which after use of the security barrier can be released, and the security barrier unzipped for recovery purposes.

Existing crowd control security barriers have certain disadvantages with respect their efficacy, particularly in the face of determined assault. Although different problems pertain to different types of barrier, generally they are too easy to scale, topple, dismantle and/or otherwise breach. Gabion type security barriers have not generally been used as crowd control security barriers, and are generally not suited for this purpose.

Accordingly, there is a need for an improved security barrier, in particular a crowd control security barrier which is robust, and not easily breached.

BRIEF DESCRIPTION OF THE DRAWINGS

The invention will now be more particularly described with reference to the following drawings.

DETAILED DESCRIPTION

Figure 1:
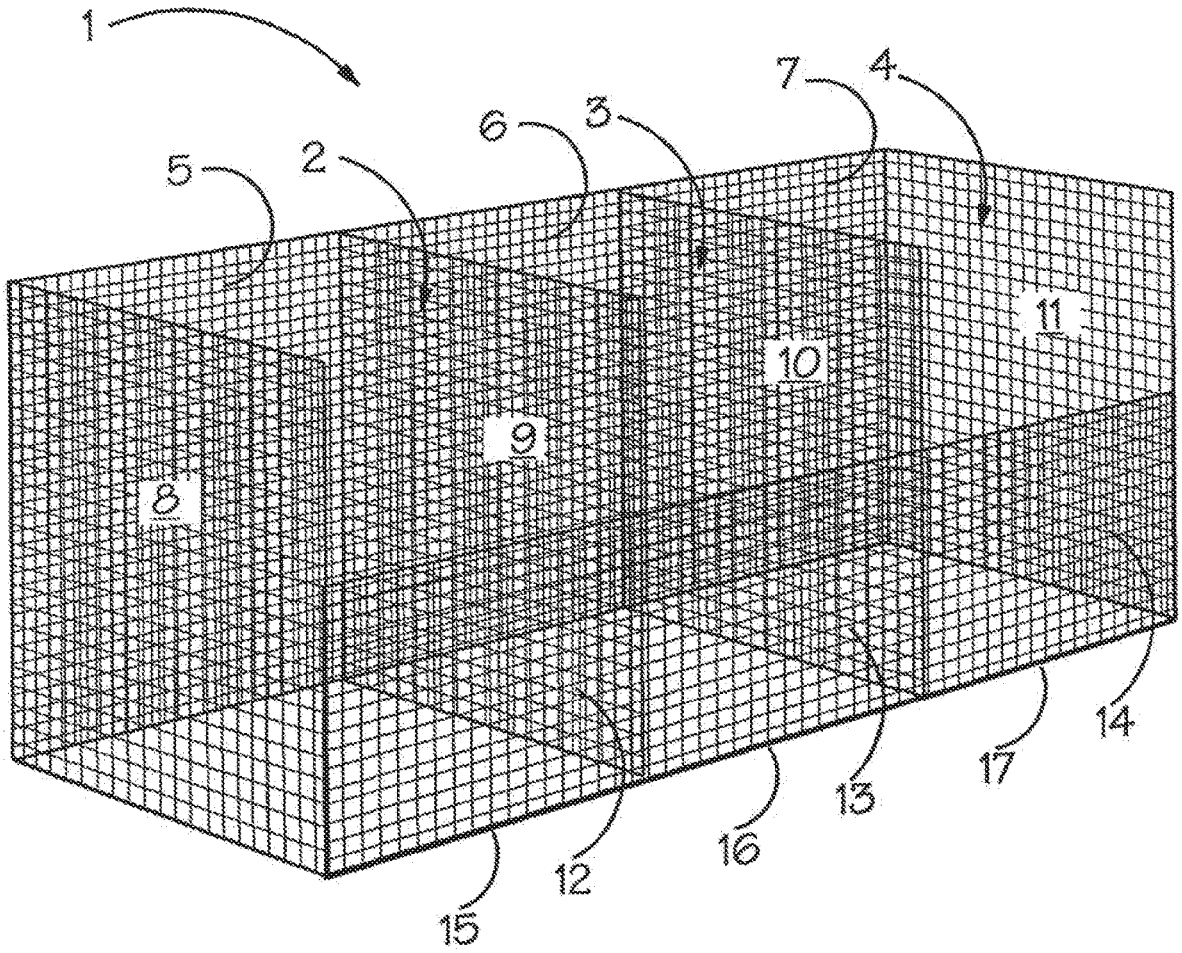
FIG. 1 shows a schematic perspective view of a multi-compartmental security barrier in accordance with the invention.

Security barriers which are the subject of this invention may be used for temporary crowd control purposes, for example at conferences, summits, concerts, festivals, marches and potentially hostile congregations of people. In some cases, security barriers may also be deployed to afford temporary or semi-permanent access protection to protect military, diplomatic or civilian installations from personnel assault. For convenience, such security barriers will be referred to as crowd control security barriers.

According to the present invention there is provided a security barrier for deployment in crowd control and/or containment, the security barrier being capable of adopting at least two configurations, namely:

- a first configuration in which the security barrier is erected for deployment and comprises a compartment bounded at its front by a front panel for providing a barricade, at its rear by a rear panel of lower height than the front panel, at its sides by respective side panels pivotally connecting the rear and front panels, and at its bottom by a bottom panel connected to at least two of the front panel, the rear panel, and the respective side panels; and
- a second configuration in which the security barrier is collapsed for storage and/or transportation, the bottom panel being folded up against any one of the front, rear or side panels and connected to the said panel by means of a pivotal connection, the pivotal connections between the side panels and the respective front and rear panels allowing those panels to adopt a substantially flattened configuration together with the folded-up bottom panel.

In its deployed configuration the security barrier of the invention is preferably self-supporting and presents a relatively tall front panel as the barricade. The height of the front panel in the deployed configuration is preferably at least about six feet, preferably at least about seven feet, more preferably at least about eight feet, still more preferably at least about nine feet, and most preferably at least about ten tall.

The rear panel is of lower height than the front panel. Preferably the height of the rear panel in the deployed configuration is not more than about five feet, more preferably not more than about four feet and most preferably no more than about three feet. The relatively lower height of the rear panel facilitates access to the compartment for a fork-lift truck or other lifting apparatus to lower into the compartment a heavy weight, such as for example a "big bag" of sand or stones. The weight is preferably at least about 100 kg, more preferably at least about 250 kg and most preferably at least about 500 kg. A typical "big bag" filled with sand for example weighs about 855 kg.

According to the invention there is provided a security barrier in which a weight is received in the compartment in the erected configuration of the barrier.

The weight deployed in the compartment in the erected configuration of the barrier bears upon the bottom panel and is effective, because the bottom panel is secured to the front panel and to the rear panel and/or the side panels, to prevent toppling of the security barrier, particularly when pushed or pulled from the front.

Preferably the bottom panel is connected to the front panel and to at least one other panel.

Preferably the bottom panel is connected at least to the front panel and the rear panel. In this case, an attempt to topple the erected security barrier by pushing against the front panel will be resisted by the weight on the bottom panel and by the connection between the bottom panel and the front panel. An attempt to topple the erected security barrier by pulling the front panel will be resisted by the weight on the bottom panel and by the connection between the bottom panel and the rear panel.

However, the bottom panel may also, or alternatively, be connected to the respective side panels. Because the side panels are themselves connected to the front and rear panels, a weight bearing on the bottom panel will still hinder or prevent toppling of the barrier when pushed or pulled from the front.

The bottom panel may also be connected to the front panel, and to one or both of the respective side panels. In yet a further embodiment of the invention, the bottom panel is connected to the rear panel and to one or both of the respective side panels.

In one aspect of the present invention, the security barrier is multicompartmental, comprising a plurality of pivotally connected front panels, a plurality of corresponding pivotally connected rear panels, and a plurality of respective pairs of side panels defining therebetween multiple compartments in the erected security barrier, each compartment having a bottom panel.

Deployment of the security barrier of the invention will generally be effected by transporting the folded security barrier to a deployment site, unfolding the security barrier and folding down the bottom panel by means of its pivotal connection with at least one of the front, rear and respective side walls, securing the bottom panel to at least one other of the remaining front, rear or respective side wall, and providing the or each compartment of the security barrier with a weight material. Generally the weight material will be an easily liftable weight such as a big bag filled or part-filled with sand and/or aggregate, but alternatively or also with earth, soil, stones, rocks, rubble, concrete, debris, snow, ice, water, and combinations of two or more thereof. However, alternative weight materials may comprise concrete blocks for example.

The pivotal connection between the pivotally connected panels of the security barrier of the invention may for example be provided by a hinge member between two connected panels.

In one preferred embodiment of the invention the pivotal interconnection between connected panels may be achieved by providing interconnected panels with a row of apertures along an interconnection edge thereof and by providing a coil member helically threaded through a plurality of apertures along the interconnection edge. A single coil member may be helically threaded through the connection edge apertures of two (or more) neighbouring panels to achieve pivotal interconnection therebetween. Accordingly, there is provided in accordance with the invention a multicompartmental security barrier as described wherein at least one pivotal connection is provided by the presence of a coil member helically threaded through connection edge apertures of connected panels.

Thus, there is provided in accordance with the invention a multicompartmental security barrier as described wherein the or at least one hinge member comprises a helical coil.

Two or more security barriers of the invention may be placed side by side to form a security wall. In this case it may be desirable to secure respective end panels of neighbouring security barriers to each other by means of a suitable interconnection member. For example, such an interconnection member may itself comprise a helical coil threaded between interconnection surface apertures of neighbouring end panels. Conveniently the end panels are of a mesh material and the mesh apertures themselves serve as interconnection surface apertures. Preferably the interconnection member is situated away from the front panel so as to reduce the risk of tampering from the front of the barrier.

The security barrier panels may be of any suitable material, for example steel, aluminium, titanium, any other suitable metal or alloy, or from a plastic, ceramic or natural material such as timber. Normally, steel is preferred, in which case the steel is preferably treated to prevent or hinder steel erosion during deployment of the security barrier. The panel may be a closed panel or may be a mesh panel. In the case of a closed panel, connection edge apertures where needed will normally be machined or otherwise provided in the panel edge. In the case of a mesh panel the mesh apertures may serve as connection edge apertures where needed.

Preferably at least the front panel of the security barrier is a mesh panel, in which the mesh size is sufficiently small for the panel to be an "anti-climb" panel. Generally, the mesh width on the front panel is no more than about 6 inches, preferably not more than about 5 inches, more preferably not more than about 4 inches and most preferably not more than about 3 inches wide. Generally the mesh height on the front panel is no more than about 2 inches, preferably no more than about 1.5 inches, more preferably not more than about 1 inch and most preferably not more than about ½ inch high.

The rear, side and bottom panels may be formed from metal mesh of, for example four inches by four inches mesh size.

Preferably, the multi-compartmental security barrier of the invention comprises a cage structure.

Also preferably, the security barrier comprises pivotally interconnected, preferably open meshwork, panels which are connected together under factory conditions so that the security barrier can take a flattened form for transportation to site where it can be erected to take a form in which panels thereof define front, rear, side, bottom and end walls and an open top through which the compartments of the security barrier may be filled. Preferably, under factory conditions said panels define front, rear, side, bottom and end walls and are pivotally interconnected edge to edge and are relatively foldable to lie face to face in the flattened form for transportation to site and can be relatively unfolded to bring the security barrier to the erected condition without the requirement for any further connection of the walls site, save for the connection of the bottom panel to at least one of the front, rear or respective side walls to which the bottom panel is unconnected in its folded configuration.

In one embodiment of the invention, the front and rear panels of the security barrier each comprise a plurality of front and rear side panel sections pivotally connected edge to edge and folded concertina fashion one relative to another. The front and rear panels are connected by respective side panels which are pivotally connected thereto, the security barrier structure being adapted to be erected on site by pulling it apart by the end walls so that when it is moved from the flattened form to the erected condition the front and rear walls unfold and define with the end walls and partition walls an elongated wall structure having a row of cavities to be provided with a weight material and of which each partition wall is common to the pair of cavities adjacent the partition wall.

The invention will now be more particularly described with reference to the following drawings.

Referring to FIG. 1, there is shown a multi-compartmental security barrier 1 in accordance with the invention. This barrier consists of three separate compartments 2, 3 and 4. The compartments are themselves defined by front panels 5, 6 and 7, by respective side panels 8, 9, 10 and 11, by rear panels 12, 13 and 14, and by bottom panels 15, 16 and 17.

Security barrier 1 is shown in its erected configuration, and formed from metal mesh panels—although other suitable materials may of course be used. The metal mesh is shown schematically in FIG. 1 as a four inch by four inch mesh as far as the side, rear and bottom panels are concerned, and as a three inch by half inch mesh as far as the front panels are concerned (although the mesh is depicted uniformly for schematic purposes in FIG. 1).

The smaller size of the mesh in front panels 5, 6 and 7 provides an anti-climb facility to security barrier 1. The front panels depicted in FIG. 1 are approximately ten feet tall. By contrast, the rear panels are considerably shorter to allow access to compartments 2, 3 and 4 for the placement of heavy weights bearing down on bottom panels 15, 16 and 17. These heavy weights are not shown in FIG. 1, but would conveniently comprise a "big bag" filled with sand or earth or other suitable material.

Figure 4:
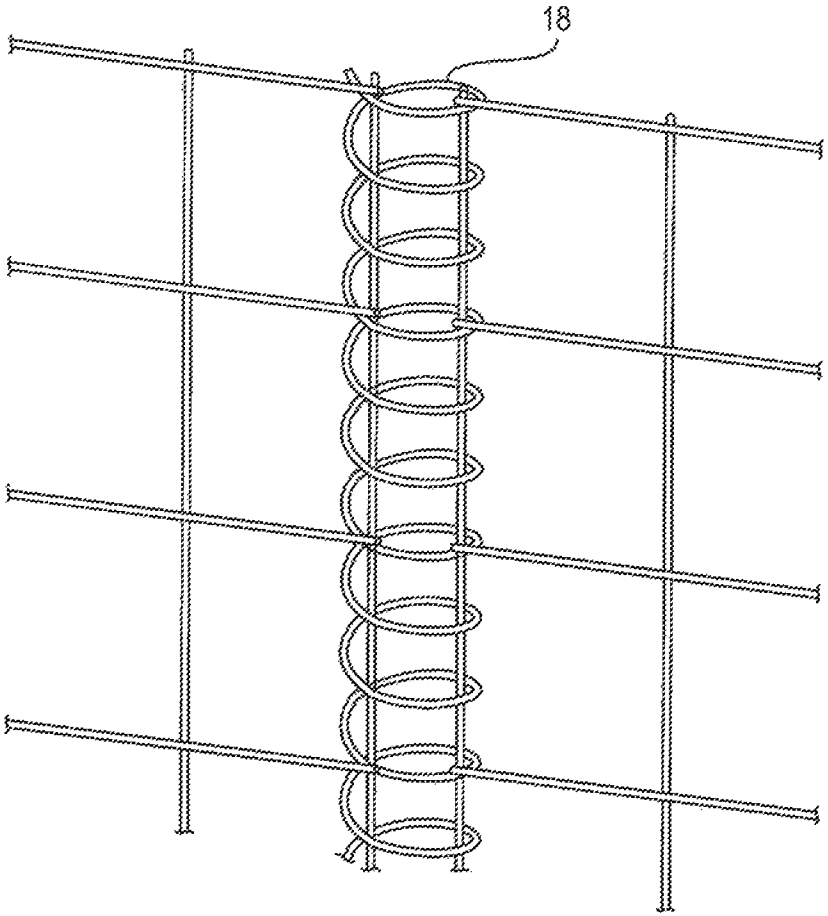
FIG. 4 shows a type of pivotal connection between neighbouring panels of the security barrier shown in FIGS. 1 to 3.

Side panels 8 and 9 are pivotally connected to front panel 5 by means of a hinge connection which is not shown in FIG. 1. but one general type of which is shown in FIG. 4 to be described later. Pivotal or foldable connections of the same or a different type are deployed at the interconnection edge between side panels 8 and 9 and rear panel 12.

Figure 2:
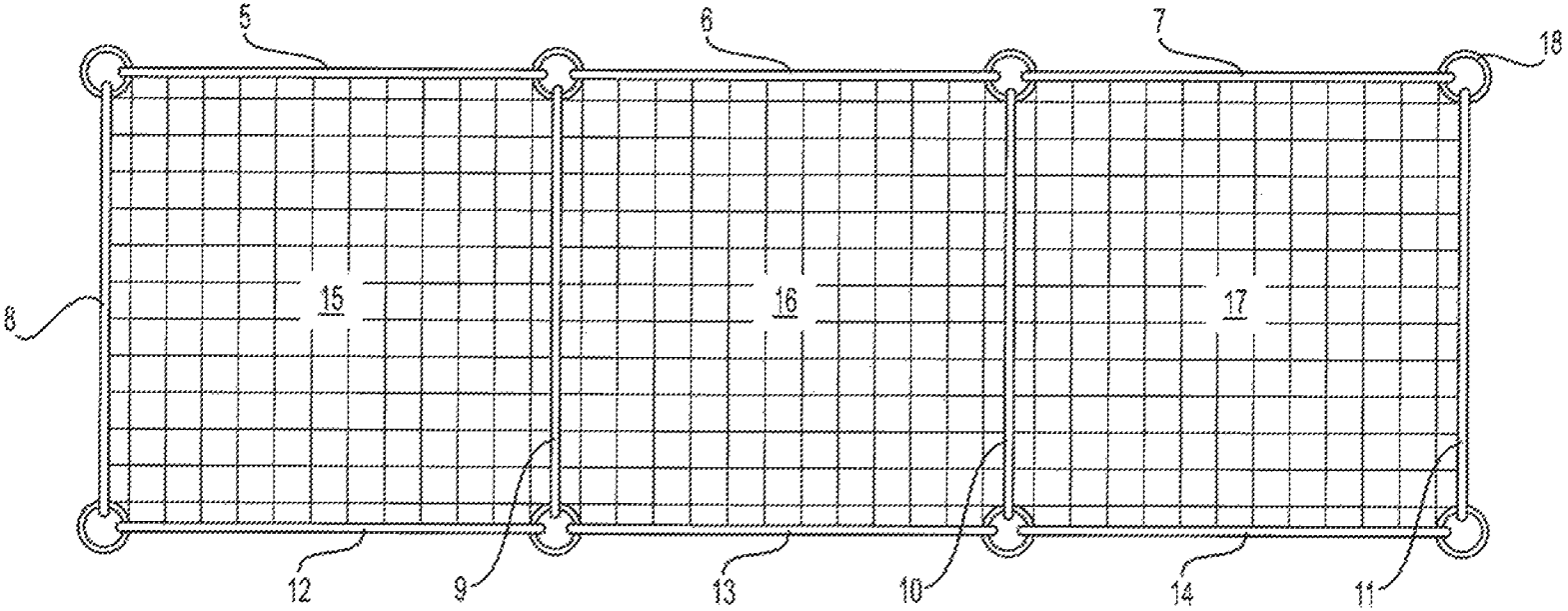
FIG. 2 shows the multi-compartmental security barrier of FIG. 1 in schematic form from a top plan view.

Referring now to FIG. 2, there is shown a top plan view of the security barrier of FIG. 1 in which the pivotal connection between the respective front, side and rear panels can be seen. These pivotal interconnections remain in place when the security barrier is flattened to its collapsed configuration for transportation and/or storage, as shown in FIG. 3.

Figure 3:
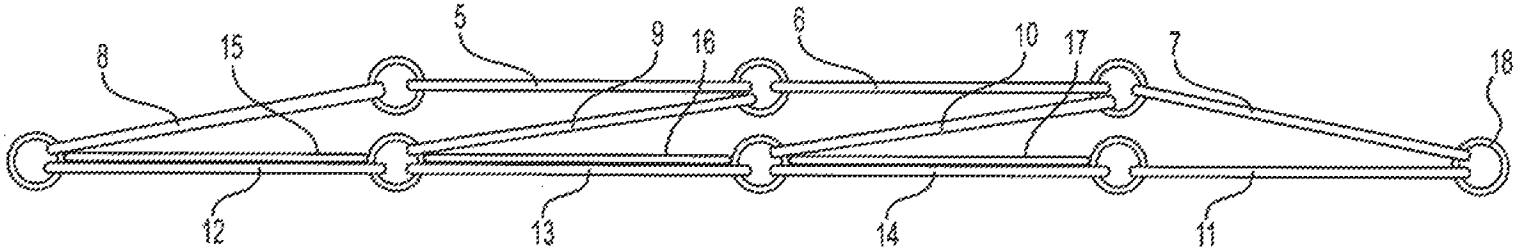
FIG. 3 shows in schematic top-plan form the multi-compartmental security barrier of FIG. 2 when adopting a collapsed configuration for transportation and/or storage; with the bottom panels not shown for clarity.

Not shown in FIG. 3 (to avoid complexity of the drawing) are bottom panels 15, 16 and 17 which in the collapsed condition remain pivotally connected to one of the front, rear or side panels. In the flattened configuration shown in FIG. 3, the bottom panel is folded up against the front, rear or side panel to which it is pivotally connected.

One type of pivotal connection is shown in FIG. 4, in which helical coil spring 18 is coiled through the mesh panels of neighbouring sections of the security barrier. Helical coils 18 are also shown in FIGS. 2 and 3, but not in FIG. 1.

If bottom panels 15, 16 and 17 are pivotally connected in the collapsed condition front panels 5, 6 and 7 then when the security barrier is erected the bottom panels are dropped down from their folded up orientation against front panels 5, 6 and 7, and then secured to at least one of their neighbouring side or rear panels with a suitable means of connection. Such means might include clips, fasteners and ties of a variety of design, but may also include helical coil springs of the same type used for the pivotal interconnections between connected panels of the security barrier.

Figure 5A:
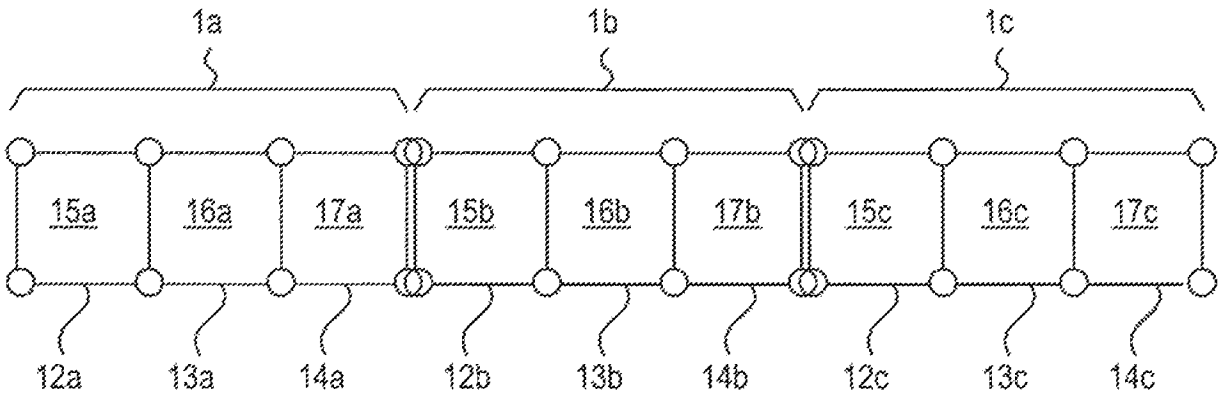
FIG. 5A shows a wall arrangement of three connected multi-compartmental security barriers shown of FIGS. 1 to 3, in schematic form from a top plan view.

In FIG. 5A, there is shown a top-down plan view of three multicompartmental security barriers 1*a*, 1*b*, and 1*c* of FIG. 2 which form a security fence. The barriers are placed side by side and with neighbouring side walls connected together by means of suitable connecting elements, for example by helical coil springs or by other types of fastener, to create a wall of security barriers. Preferably, the means of connection is kept away from the front edge so as to minimize the risk of tampering from miscreant elements beyond the front panel. The meshwork of the bottom panels 15, 16, and 17 is not depicted in these figures.

Figure 5B:
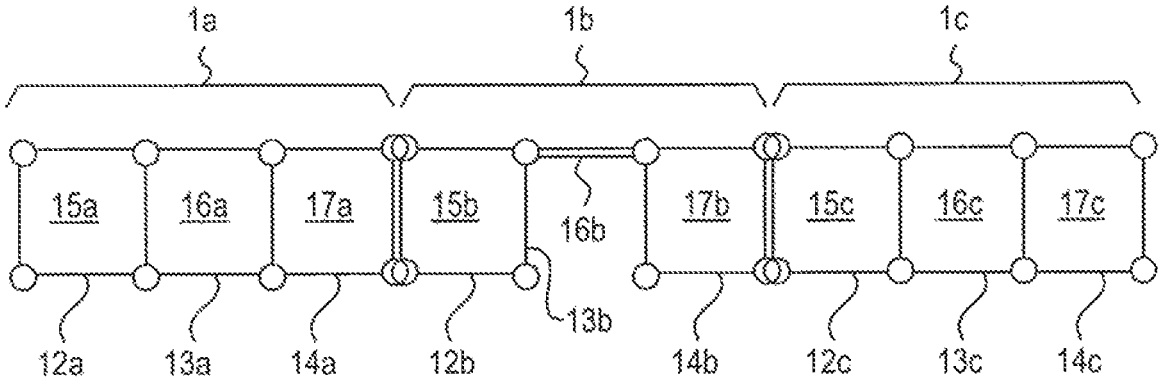
FIG. 5B shows the wall arrangement of FIG. 5A with one compartment bottom panel folded up against the front panel and the back panel of said compartment folded against a side panel.
Figure 5C:
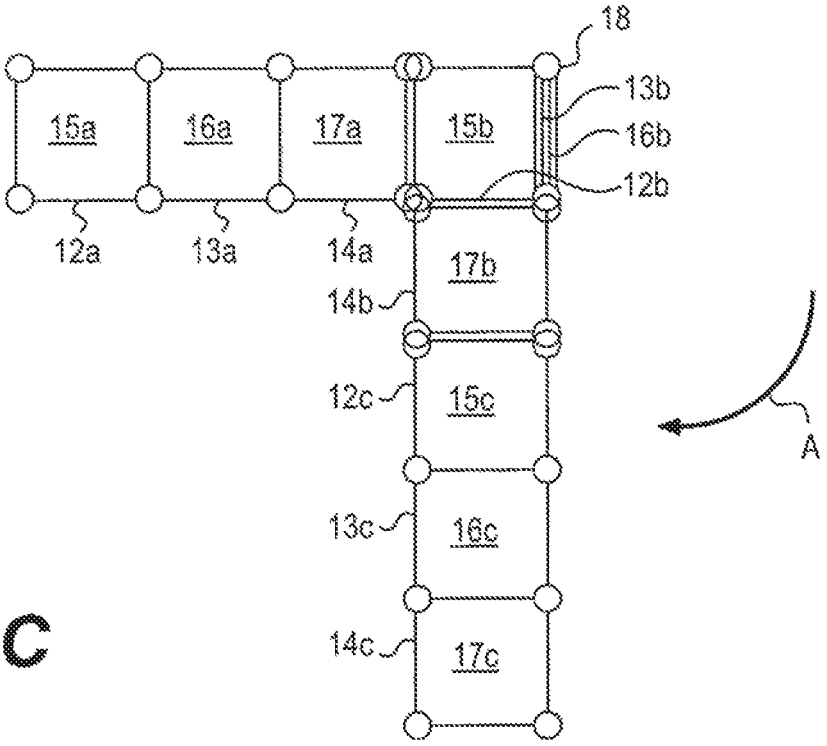
FIG. 5C shows the wall arrangement of FIG. 5B having one section rotated to create a secure 90 degree turn in the wall.
Figure 6A:
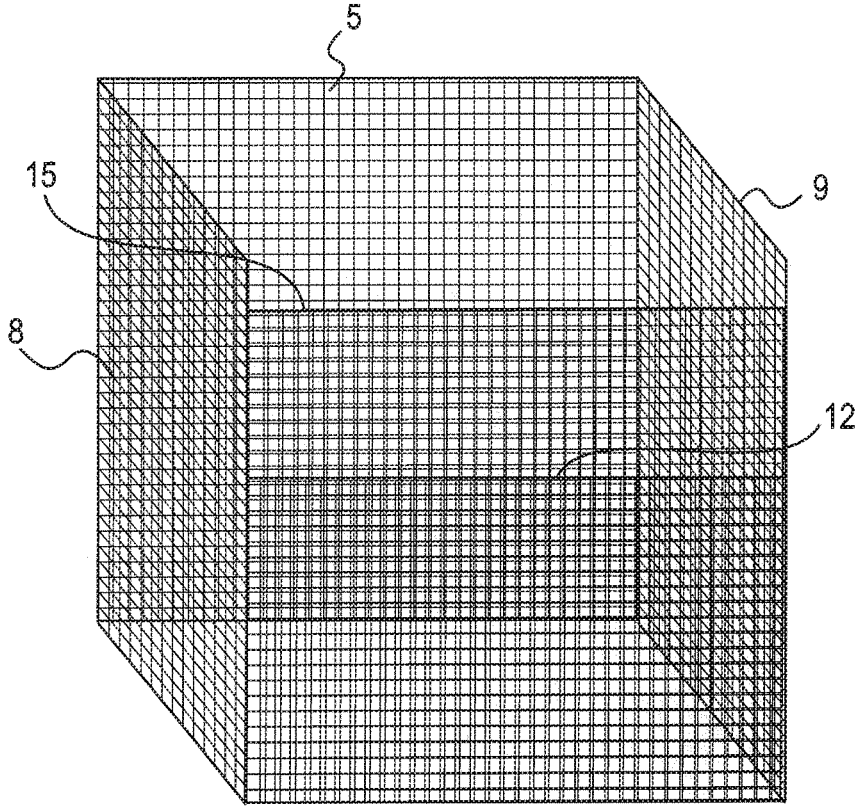
FIGS. 6A-6D show schematic perspective views of a bottom panel folded up in a security barrier in accordance with the invention against the back (FIG. 6A) back; side (FIGS. 6B and 6D); or front (FIG. 6C) front of a compartment.
Figure 6B:
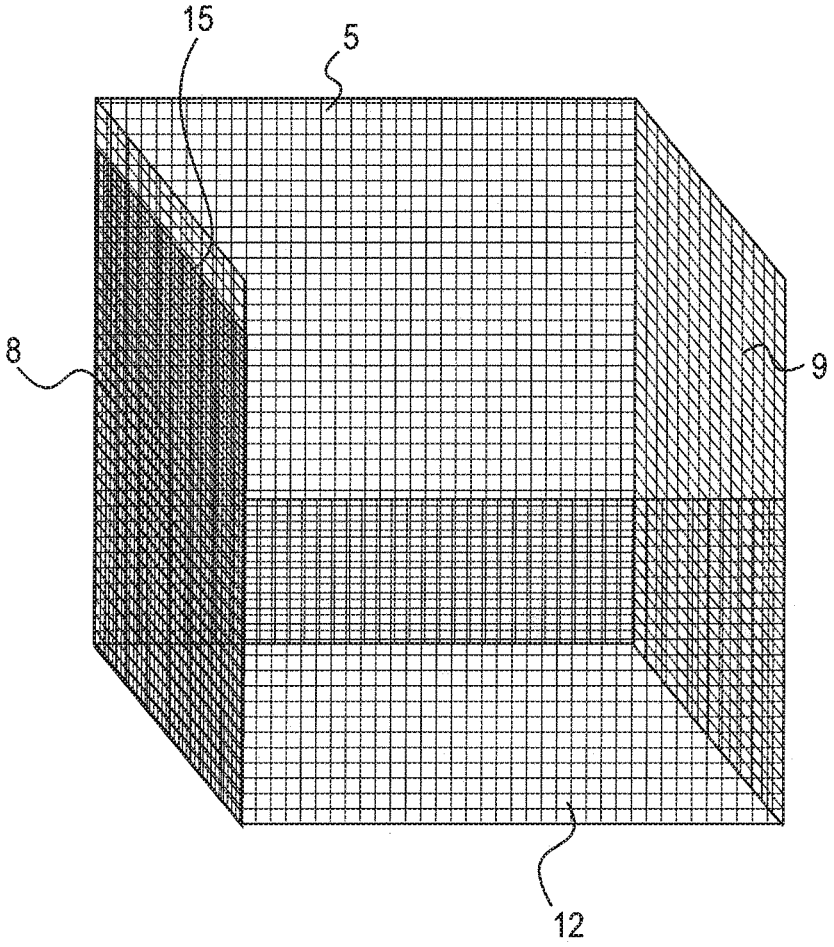
Figure 6C:
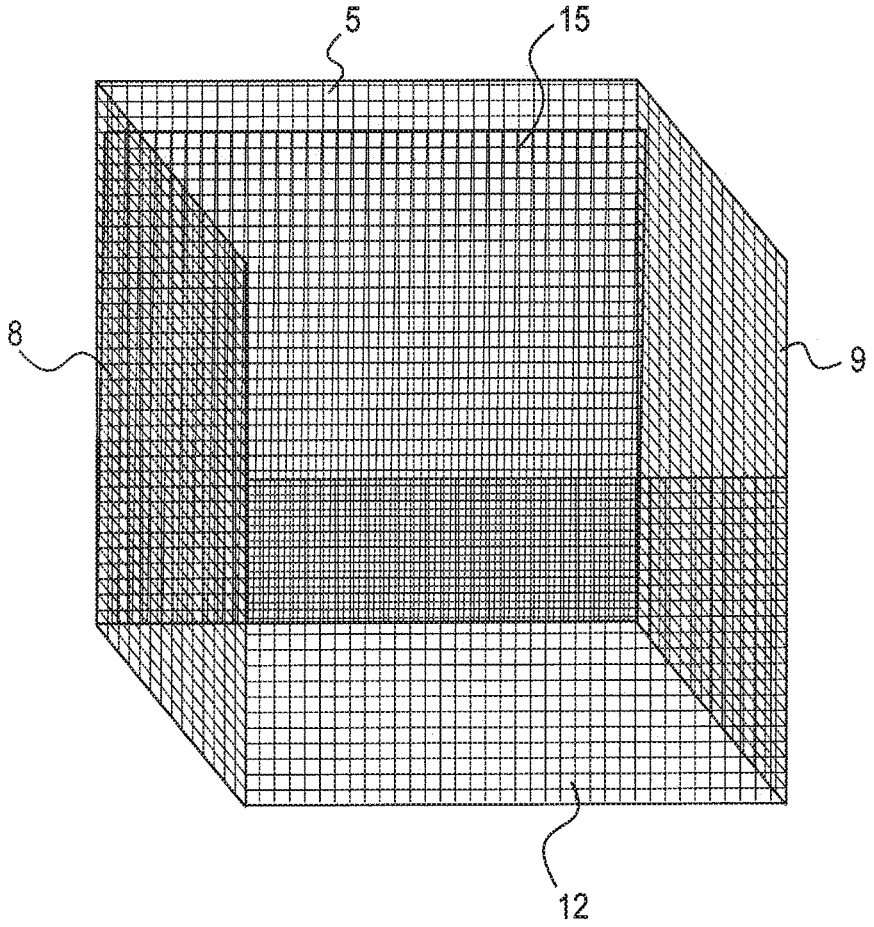
Figure 6D:
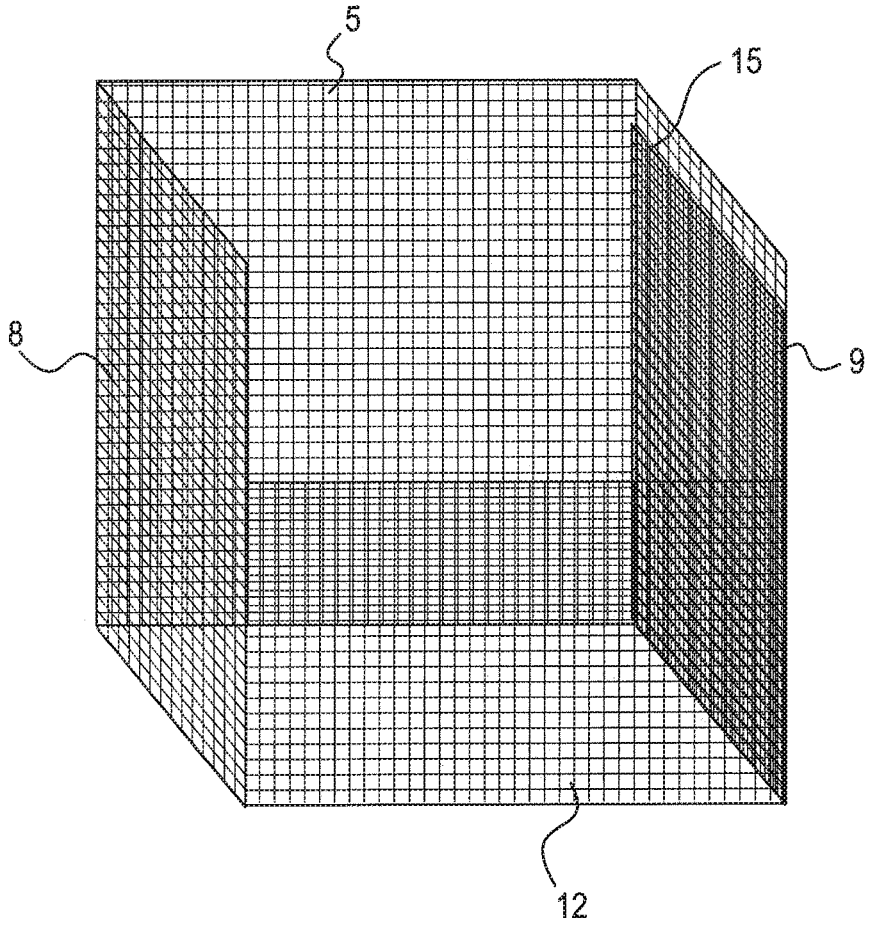

FIG. 5B shows the security wall of FIG. 5A, but with the bottom panel 16*b* of the middle security barrier 1*b* folded up against the front panel and with rear panel 13*b* of the middle security barrier 1*b* folded inward against a side panel. As shown in FIG. 5C, the third compartment of the second multi-compartmental security barrier 1*b* and the third multi-compartmental security barrier 1*c*, can then be pivoted 90 degrees about connection 18 to create a 90 degree turn in the wall.

The turn can be made using any compartment of a security fence allowing a wide range of configurations. Making the turn using the middle cell of a security barrier rather than at a connection of two separate security barriers can create a more secure turn in the fence.

The security barrier of the invention may be provided with any suitable number of compartments. For example, a single-compartment barrier would comprise simply side walls 8 and 9 together with front panel 5, rear panel 12 and bottom panel 15. It may also be desirable to provide corner units of a type in which the end side panel, and optionally the end-most rear and/or bottom panels are missing.

Referring to FIGS. 6A-6D, there is shown a compartment of a security barrier 1 in accordance with the invention. The compartment is defined by front panel 5, by respective side panels 8 and 9, by rear panel 12, and by bottom panel 15. Bottom panel 15 is shown folded up against rear panel 12 (FIG. 6A), side panel 8 (FIG. 6B), front panel 5 (FIG. 6C, and side panel 9 (FIG. 6D), respectively.

Figure 7:
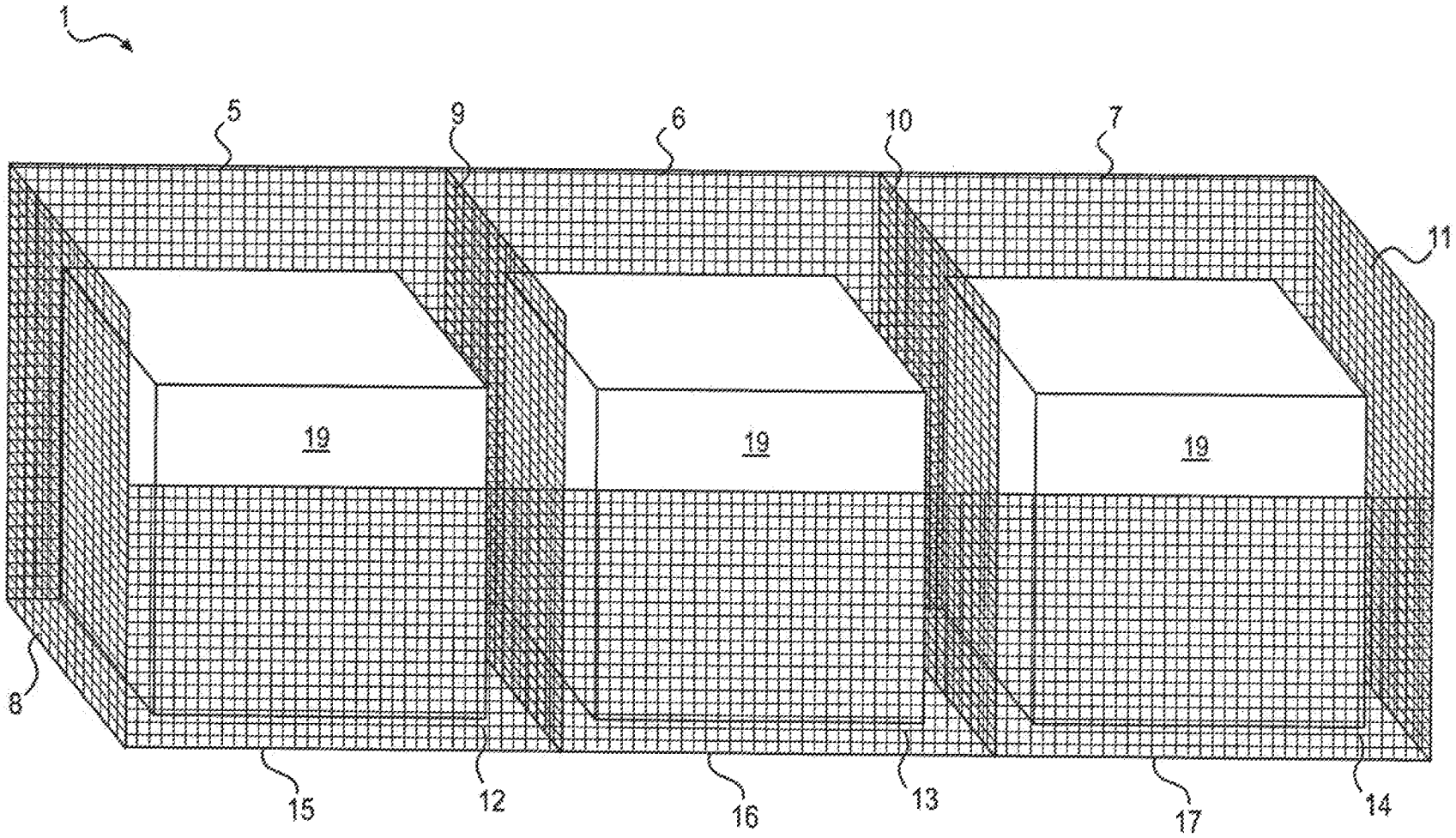
FIG. 7 shows a schematic perspective view of a multi-compartmental security barrier in accordance with the invention comprising ballast weights.

Referring to FIG. 7, there is shown a multi-compartmental security barrier 1 in accordance with the invention. This barrier consists of three separate compartments 2, 3 and 4. The compartments are themselves defined by front panels 5, 6 and 7, by respective side panels 8, 9, 10 and 11, by rear panels 12, 13 and 14, and by bottom panels 15, 16 and 17. A ballast weight 19 is shown in each compartment.

What is claimed is:

1. A multi-compartmental security barrier for deployment in crowd control or containment, comprising:

a plurality of front panels providing a removable crowd control barricade, each front panel comprising a pair of side edges and a lower edge, wherein said front panels are pivotably connected to one another along adjacent said side edges by a hinge member therebetween;

a plurality of rear panels having a lower height than the front panels and providing a rear access area vertically above the rear panels for accommodating a lifting device that deploys weight into the security barrier, each rear panel comprising a pair of side edges and a lower edge, wherein said rear panels are pivotably connected to one another along adjacent said side edges by a hinge member therebetween;

a plurality of side panels, each comprising a pair of side edges and a lower edge, wherein each side edge of each said side panel is pivotably connected to the side edge of a corresponding at least one said front panel or said rear panel along the adjacent corresponding edges by a hinge member therebetween, such that each pair of adjacent said side panels and corresponding said front and said rear panels interposed therebetween define a respective one of a plurality of compartments in a deployed configuration of the barrier; and a plurality of bottom panels, each comprising a pair of side edges, a front edge and a rear edge, wherein either the front edge or rear edge of each bottom panel is pivotably connected to the lower edge of a corresponding said front panel or said rear panel along the adjacent corresponding edges by a hinge member therebetween, wherein for storage or transportation of the barrier to a deployment site, each bottom panel can be folded up against the corresponding front or rear panel to which it is pivotably connected, and the plurality of side panels of the barrier can be folded about their pivotal connections such that the plurality of front and rear panels adopt a substantially flattened, folded configuration, and wherein in the deployed configuration of the barrier, the barrier is unfolded and each said bottom panel is further secured to the lower edge of the other of its corresponding front and rear panels, and a ballast weight material is removably provided in each compartment and bears upon the bottom panel to prevent toppling of the barrier when pushed or pulled from the front.

2. The security barrier according to claim 1, wherein the height of each front panel in the deployed configuration is at least about six feet.

3. The security barrier according to claim 1, wherein the height of each rear panel in the deployed configuration is not more than about five feet.

4. The security barrier according to claim 1, wherein each bottom panel is connected to the lower edge of each of the corresponding said side panels in the deployed configuration of the barrier.

5. The security barrier according to claim 1, wherein each bottom panel is connected to the lower edge of one or both of the corresponding side panels in the deployed configuration of the barrier.

6. The security barrier according to claim 1, wherein the bottom panel and the rear panel of at least one compartment is arranged to be foldable against any one of its corresponding front or side panels by means of a pivotal connection, allowing the bottom panel and rear panel to adopt a substantially flattened configuration against the respective front or side panel so as to enable the front panel to adopt a substantially flatted configuration against a side panel of an adjacent compartment in the deployed configuration to create a turn in the security barrier.

7. The security, barrier according to claim 1, wherein the ballast weight material comprises a big bag filled or part-filled with sand, earth, soil, stones, rocks, rubble, concrete, debris, snow, ice, water, and combinations of two or more thereof.

8. The security barrier according to claim 1, wherein the pivotal interconnection between connected panels is achieved by providing interconnected panels with a row of apertures along an interconnection edge thereof and by providing a coil member helically threaded through a plurality of apertures along the interconnection edge.

9. The security barrier according to claim 8, wherein a single coil member is helically threaded through the connection edge apertures of two or more neighbouring panels to achieve pivotal interconnection therebetween.

10. The security barrier according to claim 1, wherein each front panel is formed from a mesh material.

11. The security barrier according to claim 10, wherein the mesh material has a mesh size small enough for an anti-climb panel.

12. The security barrier according to claim 11, wherein the mesh material on each front panel has a mesh width of no more than about 6 inches.

13. The security barrier according to claim 11, wherein the mesh material on each front panel has a mesh height of no more than about 2 inches.

14. A security wall formed from a plurality of security barriers of claim 1, placed side by side and secured to each other by means of an interconnection member.

15. The security wail according to claim 14, wherein the interconnection member comprises a helical coil threaded through interconnection surface apertures of neighbouring end panels.

16. A method for creating a secure substantially 90 degree turn in an erected security wall formed from the multi-compartmental security barrier of claim 1, the method comprising:

aligning the plurality of compartments in a longitudinal direction from one end to another end, selecting one of the plurality of compartments that is not an end compartment so that the one of the plurality of compartments divides the multi-compartmental security barrier into a first portion and a second portion, folding up a bottom panel and a rear panel of the one of the plurality of compartments against any one of its corresponding front or side panels, and pivoting the second portion of the multi-compartmental security barrier 90 degrees around the collapsed one of the plurality of compartments so that the first portion and the second portion are attached to each other at a 90 degrees angle.

17. The security barrier of claim 1, wherein the front panels and the rear panels are configured to receive a bag of fill material weighing at least 500 kg.

* * * * *